US006440582B1

(12) United States Patent
McDevitt et al.

(10) Patent No.: US 6,440,582 B1
(45) Date of Patent: Aug. 27, 2002

(54) COATING COMPOSITION FOR STEEL PRODUCT, A COATED STEEL PRODUCT, AND A STEEL PRODUCT COATING METHOD

(75) Inventors: Erin T. McDevitt, Bethlehem; Scott A. Kriner, Macungie, both of PA (US)

(73) Assignee: Bethlehem Steel Corporation

( * ) Notice: Subject to any disclaimer, the term of this patent is extended or adjusted under 35 U.S.C. 154(b) by 0 days.

(21) Appl. No.: 10/105,782

(22) Filed: Mar. 25, 2002

Related U.S. Application Data

(63) Continuation-in-part of application No. 09/414,766, filed on Oct. 7, 1999.

(51) Int. Cl.[7] ..... B32B 15/00

(52) U.S. Cl. ..... 428/653; 75/678; 75/684; 427/368; 428/627; 428/659; 428/687; 428/939

(58) Field of Search ..... 428/653, 627, 428/659, 687, 939; 427/368; 75/678, 684

(56) References Cited

U.S. PATENT DOCUMENTS 4,287,008 A * 9/1981 Torok et al. ..... 428/653
4,401,727 A * 8/1983 Berke et al. ..... 428/653
4,873,153 A * 10/1989 Miller ..... 428/659

* cited by examiner

*Primary Examiner*—Robert R. Koehler
(74) *Attorney, Agent, or Firm*—Harold I. Masteller, Jr.

(57) ABSTRACT

A method of coating of steel products such as plate and sheet using an aluminum-zinc coating alloy includes modifying the coating bath with a particulate compound constituent in effective amounts to decrease the spangle facet size of the coated product, improve tension bend rust stain performance, improve coated surface appearance when brushed, and coated product paintability. Constituents include borides such as titanium boride and aluminum borides, carbides such as titanium carbide, and aluminides such as titanium aluminide. The method produces a coated steel product that does not require temper rolling for painting.

16 Claims, 9 Drawing Sheets

NORMAL GALVALUME – NO $TiB_2$ ADDITION

MIN. SPANGLE GALVALUME – 0.02% Ti, 0.004% B

MIN. SPANGLE GALVALUME – 0.04% Ti, 0.008% B

NORMAL GALVALUME – NO TI ADDITION

MIN. SPANGLE GALVALUME – 0.02% TI, 0% B

MIN. SPANGLE GALVALUME – 0.04% TI, 0% B

NORMAL GALVALUME – NO TIC ADDITION

MIN. SPANGLE GALVALUME – 0.02% Ti, 0.001% C

MIN. SPANGLE GALVALUME – 0.2% Ti, 0.01% C

NORMAL GALVALUME – NO $AlB_{12}$ /$AlB_2$ ADDITION

MIN. SPANGLE GALVALUME – 0% Ti, 0.03% B

MIN. SPANGLE GALVALUME – 0% Ti, 0.06% B

BRUSHED GALVALUME WITH NO $TiB_2$ ADDITION

BRUSHED GALVALUME WITH $TiB_2$ ADDITION

COATING COMPOSITION FOR STEEL PRODUCT, A COATED STEEL PRODUCT, AND A STEEL PRODUCT COATING METHOD

This is a continuation-in-part of application Ser. No. 09/414,766 filed Oct. 7, 1999.

FIELD OF THE INVENTION

The present invention is directed to a coating composition, a coated steel product, and a method of making, and in particular, to an aluminum-zinc coating composition employing effective amounts of a particulate compound constituent to enhance tension bend rust stain performance and the appearance of the sheet when painted and reduce spangle facet size.

BACKGROUND ART

The coating of steel components with aluminum-based coating alloys, commonly referred to a hot dip coating, is well known in the prior art. One particular type of coating is trademarked as Galvalume® which is owned by BIEC International, Inc., and is representative of an aluminum-zinc coating alloy.

These materials are advantageous as building materials, particularly wall and roof construction due to their corrosion resistance, durability, heat reflection, and paintability. Typically, these materials are manufactured by passing a steel product such as a sheet or plate through a bath of a melted alloy coating composition comprising aluminum, zinc, and silicon. The amount of coating applied to the steel products is controlled by wiping, and then the products are cooled. One characteristic of the coating applied to the steel product is its grain size or spangle facet size.

U.S. Pat. No. 3,343,930 to Borzillo et al., U.S. Pat. No. 5,049,202 to Willis et al. and U.S. Pat. No. 5,789,089 to Maki et al. disclose methods and techniques for the manufacture of steel sheets coated with these aluminum-zinc alloys. The three references are herein incorporated by reference in their entirety.

European Patent Application No. 0 905270 A2 to Komatsu et al. discloses another coating process utilizing zinc, aluminum, and magnesium. This application is directed at solving the corrosion problems associated with baths containing magnesium as an alloying element. Further, it is disclosed that the undesirable stripe pattern occurring in magnesium-containing baths does not occur in baths without magnesium.

U.S. Pat. No. 5,571,566 to Cho discloses another method of manufacturing coated steel sheet using an aluminum-zinc-silicon alloy. The object of the Cho patent is to provide a more efficient production method for manufacturing coated steel sheet. Cho meets this object by uniformly minimizing the size of spangles by introducing a large number of spangle particles into the coating which limits subsequent growth of the spangles because these particles interfere with their respective growth resulting in a smaller spangle facet size. The seed effect is achieved by using titanium as part of the molten coating composition.

A similar disclosure with respect to the use of titanium in coating baths to minimize spangle facet size is disclosed in an article entitled "Minimization of Galvalume Spangle facet size By Titanium Addition To Coating Bath", by Cho, presented for the INTERZAC 94 Conference in Canada in 1994. In this article, the author indicates that elements such as titanium, boron, and chromium produce finer spangles in a Galvalume coating, such a disclosure consisted with the disclosure of the Cho patent.

Notwithstanding the improvements suggested by Cho, presently used coated steel products still have disadvantages. One disadvantage is that, when the coated steel product is to be painted, a temper rolling is required to flatten the product in preparation for painting. Another problem is cracking when the product is a sheet and is bent. When this sheet product is bent, the coating can crack, the crack exposing the steel to the environment and premature corrosion. With presently available coated steel sheets, large cracks can form, thereby compromising the corrosion resistance of the sheet product.

In light of the deficiencies in the prior art, a need has developed to provide an aluminum-zinc coated steel product with improved bending performance, reduced spangle facet size, and improved painted surface appearance. The present invention solves this need by providing a method of coating a steel product, a coating composition and a coated steel article which, when experiencing surface cracking during bending, is still corrosion resistant and does not require temper rolling when the coated steel product is painted. The coating composition is modified with one or more particulate compound constituents such as titanium boride, aluminum boride and the like.

Additionally, discussions with customers have led to the realization that there is a long felt need to develop a less expensive product that provides the metallic look of high cost aluminum, stainless steel, and other like metal materials used in architectural applications, for example, interior functional/decorative applications such as door kick plates, counter back splashes, cabinets, furniture, and the like. The present invention is capable of solving this need by providing a brushed 55% Al and Zn alloy coated steel article that provides the appearance of a brushed stainless steel article or brushed aluminum article. Prior to the present invention, such a brushed metallic look was not available in a 55% Al and Zn alloy coated steel sheet product.

SUMMARY OF THE INVENTION

Accordingly, it is a first object of the present invention to provide an improved hot dip coating composition for steel products.

Another object of the present invention is a method of coating a steel product using a modified aluminum-zinc coating alloy.

Still further objects of the present invention are to provide a coated steel product with enhanced tension bend rust stain performance and painted appearance.

One other object of the present invention is a coated steel article employing a modified coating alloy composition.

Yet another object of the invention is a method of coating and then painting a steel product, whereby the coated steel product does not require temper rolling before painting.

A still further object of the present invention is to provide a brushed Al—Zn alloy coating having an improved visual appearance as compared to brushed conventional Galvalume coatings.

A still further object of the present invention is to provide a brushed Al—Zn alloy coated product having an improved visual appearance capable of providing an alternative materials application for more expensive brushed aluminum or brushed stainless steel material applications.

Other objects and advantages of the present invention will become apparent as a description thereof proceeds.

In satisfaction of the foregoing objects and advantages, the present invention is an improvement in the art of hot dip coating of steel products using an aluminum-zinc coating alloy. The composition of the aluminum-zinc alloy is modified by adding an effective amount of one or more of a particulate compound constituent selected from the group consisting of boride compounds having one of titanium and aluminum, aluminide compounds containing titanium and iron, and carbide compounds containing titanium, vanadium, tungsten, and iron. Preferably, the constituent is one of TiC, $TiB_2$, $AlB_2$, $AlB_{12}$, and $TiAl_3$.

The constituent can be prepared in various ways as part of the modification step, e.g., as part of a precursor or master alloy ingot or bath containing principally aluminum, the master alloy then added to an aluminum-zinc bath in the necessary proportions to arrive at a final bath composition suitable for coating and providing the benefits of the invention as a result of the modifier constituent. The constituent can be added to the master alloy as particulate compounds or can be formed in-situ in the master alloy to add to the actual coating bath.

More particularly, the composition of the coating bath can be modified by: (1) directly adding the particles (as a powder) to the coating bath or a pre-melt pot which feeds the coating bath; (2) adding an ingot than contains the required particles; the ingot may be aluminum with particles, zinc with particles, a zinc-aluminum alloy with particles, etc.; the ingot may be added to a main coating pot or a pre-melt pot; (3) adding molten bath containing the required particles, wherein the liquid may be aluminum with particles, zinc with particles, a zinc-aluminum alloy with particles, etc.; (4) in-situ reaction in the main pot or pre-melt pot, for example by the reaction of elemental species, such as titanium and boron in an aluminum feed melt, or the reaction of salts on the feed melt pot to produce particles.

The particle size of the constituent in the coating bath can vary but preferably ranges from about 0.01 and 25 microns. When practicing the invention, a spangle facet size of a coated product can range as low as 0.05 mm and up to 2.0 mm.

The effective amount of the constituent is considered to be that amount which reduces the spangle facet size of the coated product, causes an increase in the number of cracks while maintaining a smaller crack size than conventional aluminum-zinc coated products, and does not require temper rolling when painting. An overall weight percentage range of the constituent, boride, carbide, or aluminide, based on the alloy bath is believed to be between about 0.0005 and 3.5%. When the constituent is a boride, a preferred weight percentage of the constituent as part of the coating bath can range between about 0.001 and 0.5%. When the constituent is a carbide, a preferred weight percentage can range between about 0.0005 and 0.01%.

The invention also provides a coated steel article employing a coating containing the particulate compound constituent as well as the coating composition as applied to the steel product. The product is preferably a steel sheet or plate for construction purposes.

BRIEF DESCRIPTION OF THE DRAWINGS

Reference is now made to the drawings of the invention wherein.

DESCRIPTION OF THE PREFERRED EMBODIMENTS

Figure 1:
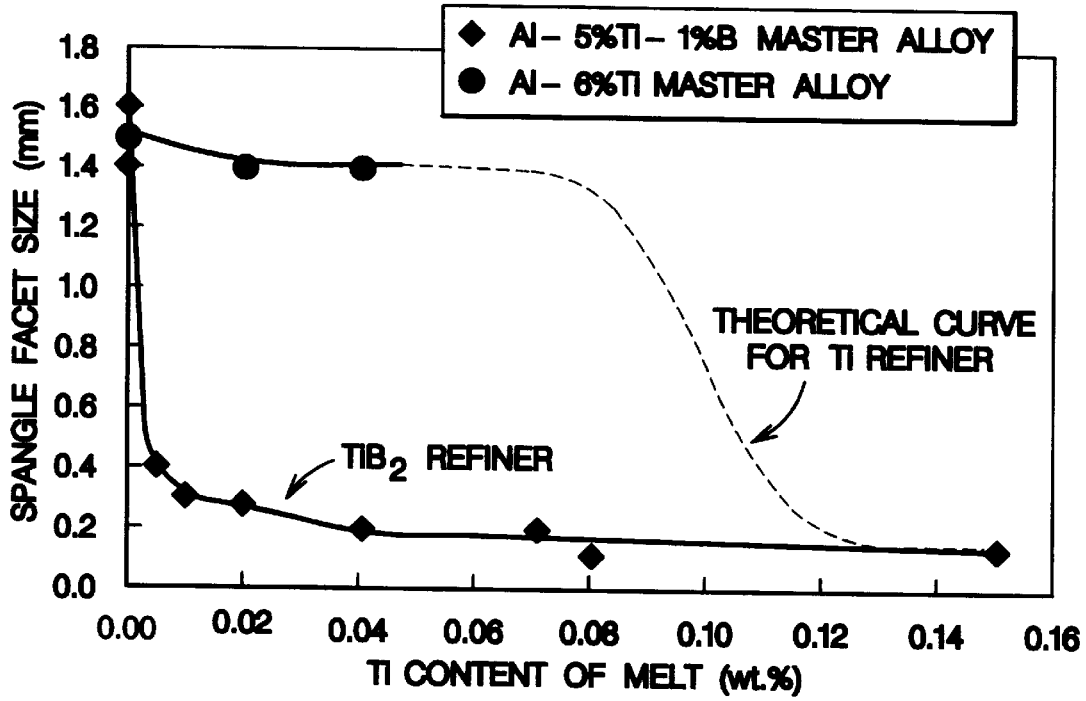
FIG. 1. is a graph comparing the use of titanium boride and titanium as melt additives for hot dip coating in terms of spangle facet size and titanium content.

The present invention advances the art of hot dipping or coating steel products, particularly plate and sheet products, using an aluminum-zinc molten alloy bath, e.g., a Galvalume bath. According to the invention, the coating bath is modified with particulate compound constituents to reduce the spangle facet size of the coated steel product. With the addition of the particulate constituents, improvements may also be realized in the performance of the coated steel product in terms of tension bend rust staining. Tension bend rust staining is a discrete pattern of cosmetic red rust running along the rib of a prepainted, roll formed, building panel caused by cracking of the metallic coating and paint.

The surface of the coated steel product also yields a painted appearance that is superior to conventional Galvalume product. This is believed to allow for the production of smooth coated steel sheet product without the need for temper rolling. Eliminating the extra processing step of temper rolling also reduces energy consumption, eliminates possible waste streams associated with temper rolling, and simplifies the production process.

In its broadest embodiments, the invention entails a novel composition for a coating of steel product, a method of making such a coating, and the article made from such method.

When coating steel products with an aluminum-zinc coating bath, the processing steps of forming the bath to the desired composition and passing the steel product to be coated through the bath are well-known. As a result, a further description of the prior art methods and apparatus to accomplish this conventional coating is not deemed necessary for understanding of the invention.

The composition of the prior art aluminum-zinc alloy baths is well-known as discussed in the Borzillo et al. and Cho patents, and the Cho publication noted above. Generally, this bath comprises about 55% aluminum, a level of silicon, generally about 1.6% by weight, and the balance zinc. Other variations in the composition are within the scope of the invention as would be conventionally known to those of ordinary skill in the art.

According to the invention, the aluminum-zinc molten bath is modified with a particulate compound constituent to achieve improvements in terms of reduced spangle facet size, improved surface finish, reduction in crack size, and potential improvements in tension bend rust staining. The particulate compound constituent can be a boride, carbide, or aluminide. Preferably, the boride compounds include titanium boride ($TiB_2$), and aluminum boride ($AlB_2$ and $AlB_{12}$). The particulate compound constituent as a carbide can be titanium carbide, vanadium carbide, tungsten carbide, and iron carbide, and as an aluminide, titanium aluminide ($TiAl_3$) and iron aluminide. The level of the particulate compound constituent is set as an amount to effectively reduce the spangle facet size over that of conventional coatings, with or without elemental titanium. While the effective amount may vary depending on which compound is selected, it is anticipated that the amount would range from about 0.0005% to about 3.5% by weight of the carbon, boron, or aluminide of the composition of the coating bath. For carbon, a more preferred range is between about 0.005% and 0.10% by weight of the bath. In terms of titanium concentration, a titanium boride containing coating melt bath could have a titanium concentration between about 0.001% and 0.1% by weight of the bath. For the boride compound, the boron weight percentage in the bath can range from 0.001% to 0.5% by weight.

Table 1 shows broad claimed ranges for the particle additions if only a single type of particle is added:

TABLE 1

| | Coating Bath Composition (wt. %) Nominally 55% Al-1.6% Si-bal. Zn | | | Wt. % Particle in |
|---|---|---|---|---|
| | Ti | B | C | the melt |
| $TiB_2$ | 0.002–1.0 | 0.001–0.5 | — | 0.007–3.5 |
| $AlB_2$ | — | 0.001–0.5 | — | 0.010–5.0 |
| $AlB_{12}$ | — | 0.001–0.5 | — | 0.005–2.5 |
| TiC | 0.0019–1.9 | — | 0.0005–0.5 | 0.0025–2.5 |

For example, for 100 g of melt, the amount of $TiB_2$ particle addition should be 0.007–3.5 grams.

The values in Table 1 assume stoichiometric additions. Excess Ti (in the case of TiC or $TiB_2$) is permissible, but not necessary.

Table 2 shows preferred ranges or optimal ranges for the particle additions:

TABLE 2

| Particle | Coating Bath Composition (wt. %) nominally 55% Al-1.6% Si-bal. Zn | | | wt. % Particles in |
|---|---|---|---|---|
| Type | Ti | B | C | the melt |
| $TiB_2$ | 0.01–0.05 | 0.002–0.1 | — | 0.014–0.7 |
| $AlB_2$ | — | 0.02–0.05 | — | 0.2–0.5 |
| $AlB_{12}$ | — | 0.02–0.05 | — | 0.2–0.5 |
| TiC | 0.011–0.38 | — | 0.003–0.1 | 0.015–0.5 |

The particle size of the particulate constituent should range between about 0.01 and about 25 microns. By coating a steel product using the inventive method, spangle facet sizes are produced which range from as low as 0.05 up to 2.0 mm.

The molten bath used to coat this steel product containing the modified aluminum-zinc alloy composition can be prepared in a number of ways. In one method, a master alloy of aluminum is prepared and is modified with the particulate compound constituent. This bath is then added to an aluminum-zinc coating bath, the proportions of the two baths calculated to arrive at a target bath composition containing the effective amount of the particulate compound constituent. The modified alloy bath would still track the conventional weight percentages of the aluminum, zinc and silicon for these types of coating baths, e.g., about 55% aluminum, 1–2% silicon, the balance zinc, since the effective amount of the particular compound constituent is a relatively low weight percentage of the overall bath amount. Methods for making master alloys are taught in U.S. Pat. No. 5,415,708 to Young et al. and U.S. Pat. No. 3,785,807, both herein incorporated by reference in their entirety.

Secondly, the master alloy containing the particles could be added to the coating bath in the form of a solid ingot. The ingot may be primarily Al, primarily Zn, or a alloy containing Zn, Al, and/or Si along with the spangle refining particles.

Alternatively, the particulate compound constituents could be added directly to the aluminum-zinc bath prior to coating a steel product.

When using aluminum boride as a bath modifier, boron particles can be added to an aluminum master alloy to facilitate incorporation of the particles into the melt and improve even distribution of the particles throughout the melt. Alternatively, aluminum boride particles can be added to the aluminum-zinc bath in the appropriate amounts.

When producing an aluminum master alloy with the particulate compound constituents such as titanium boride, some excess titanium may exist in the bath. This excess may range from 0.01% to 10% relative to the total mass of boron added. In terms of the stoichiometry, titanium additions in excess of one mole of titanium for 2 moles of boron may range from 0.002 to 4.5 excess moles. It is not believed that the excess titanium, whether present through the use of titanium boride or another titanium-containing compound such as titanium carbide or the like, is necessary to obtain the spangle refinement associated with the invention.

In preparing the alloy bath for coating, the particulate compound constituent can be introduced as a powder or formed in the bath itself. For example, titanium boride powders could be added to an aluminum bath in the appropriate weight percentages. Alternatively, elemental titanium and boron could be added to an aluminum melt and heated at sufficiently high temperatures to form titanium boride particles therein. It is preferred that the compound particles be added to the master alloy since this processing is much more effective in terms of energy consumption. Similar processing techniques can be employed for the carbides and aluminides.

It is believed that the presence of titanium and boron in a coating bath alone will not produce the grain refining benefits demonstrated above as compared to adding a compound particulate such as titanium boride. It has been reported that in aluminum casting, the separate addition of titanium and boron to an aluminum melt did not produce titanium boride particles when added at temperatures below 1000° C. (1832° F.). Instead, the titanium reacted with the aluminum to form $TiAl_3$ particles. Since the coating process is generally conducted at much lower temperatures, i.e., 593° C. (1100° F.), adding titanium and boron in elemental form to a Al—Zn coating bath would produce similar behavior. In addition, the kinetics of titanium and boron dissolution will be very slow at the low temperatures associated with the coating method. Thus, when forming the titanium boride in the bath itself, it is necessary to go beyond conventional melting parameters to achieve the necessary particulate for use in the invention.

The inventive coating method produces a coated article, wherein the coating has a coating composition including the added particulate compound constituent described above. The coated product can then be painted as is known in the art without the need for temper rolling or skin passing.

While titanium and aluminum borides, and titanium aluminide have been exemplified as spangle refiners, other carbides, such as vanadium carbide, tungsten carbide, iron carbide, and aluminum compounds such as iron aluminide, are also believed to be within the scope of the invention.

In order to demonstrate the unexpected benefits associated with the invention, studies were done comparing coated steel products using an aluminum titanium master alloy and an aluminum titanium boride master alloy. These master alloys were added to the aluminum-zinc coating alloys to form a coating bath for the steel to be tested. FIG. 1 compares two curves based on the master alloys noted above, the curves relating spangle facet size and the titanium content of the melt in weight percent. As is evident from FIG. 1, the use of a master alloy with titanium boride significantly refines the spangle facet size, particularly at much lower additional levels of titanium. For example, at a titanium content of 0.02% by weight, the reported spangle facet size is about 0.3 mm as compared to a spangle facet size of 1.4 mm when only titanium is used. Thus, not only does the boride modifier reduce spangle facet size, it also reduces cost by lowering the amount of titanium needed.

Figure 2:
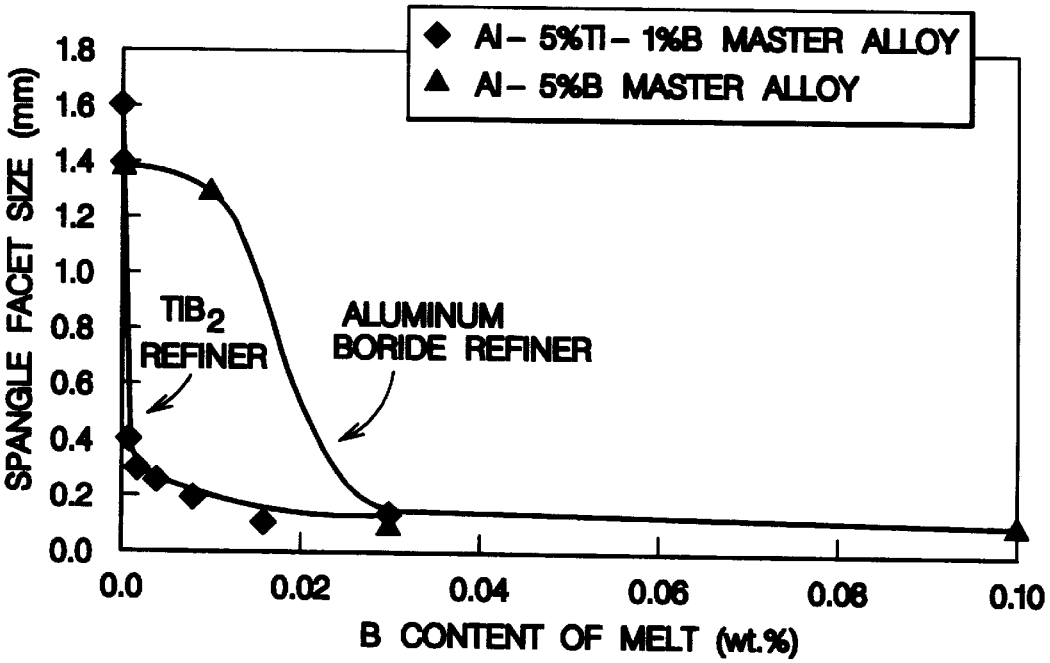
FIG. 2. is a graph comparing the use of titanium boride and aluminum boride as melt additives for hot dip coating in terms of spangle facet size and boron content.

FIG. 2 shows a similar comparison between a master alloy containing titanium boride and a master alloy of aluminum and boron. FIG. 2 shows that the titanium boride refiner achieves a smaller spangle facet size for boron levels up to about 0.03% by weight, when compared to a master alloy of just aluminum and boron. However, when comparing FIGS. 1 and 2, the use of an aluminum boride particulate compound constituent to reduce spangle facet size is more effective than just titanium.

Figure 3:
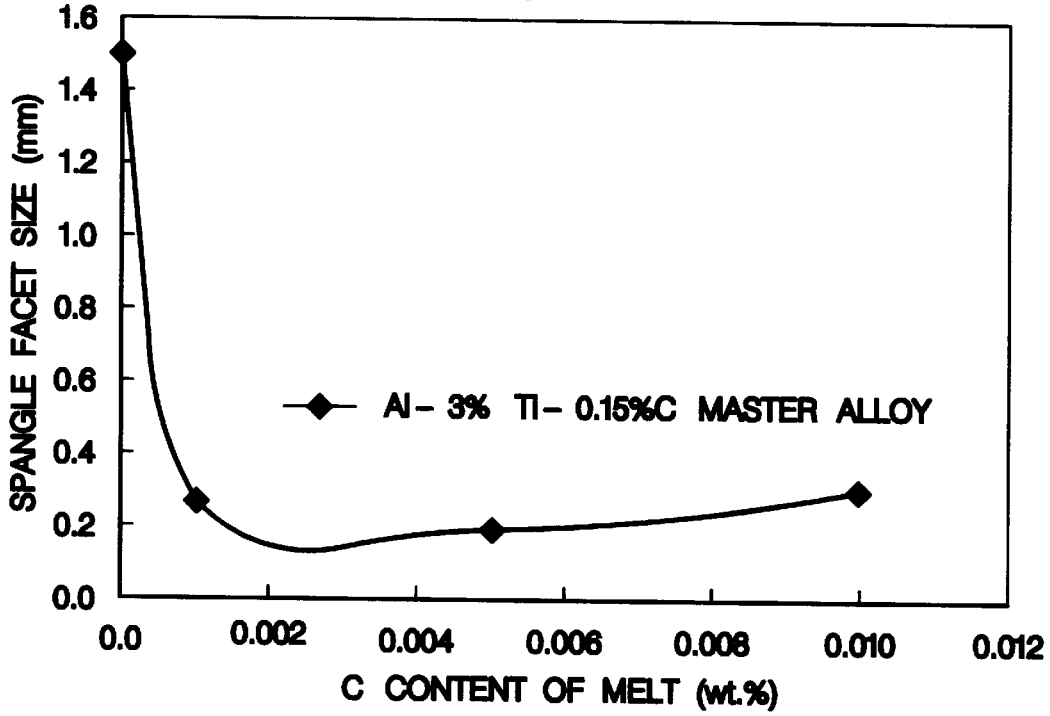
FIG. 3. is a graph comparing the use of titanium carbide as a melt additive for hot dip coating in terms of spangle facet size and carbon content.
Figure 4:
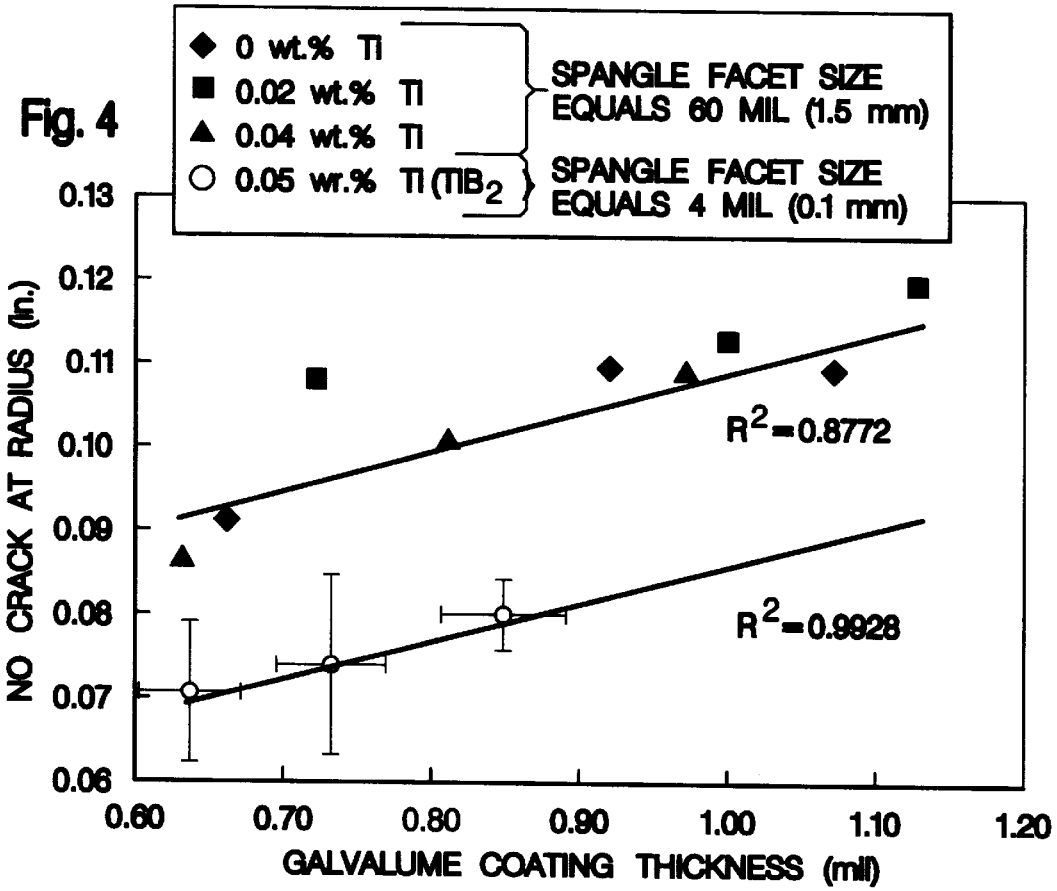
FIG. 4. is a graph showing bend test result comparisons for coating compositions modified with titanium and titanium boride.

FIG. 3 shows a graph exhibiting behavior for a coating composition modified with titanium carbide that is similar to the $TiB_2$-modified coating of FIG. 1 Besides minimizing the spangle facet size, the use of the particulate compound constituent according to the invention also allows the coated steel product to tolerate more severe bending without cracking. Referring now to FIG. 4, a comparison is made between products coated with a coating bath alloy composition employing just titanium and one employing 0.05% weight titanium boride. The spangle facet size is decreased from 1.5 mm to 0.1 mm when titanium boride is used. When the coated products are subjected to conical bend tests, the coating thickness of the product was plotted against the radius at which no crack occurred. Conical bend tests are tests that generally follow ASTM D522-93a. The product employing titanium boride as a particulate compound constituent in the coating bath decreased the no-crack radius by 23%.

Figure 5:
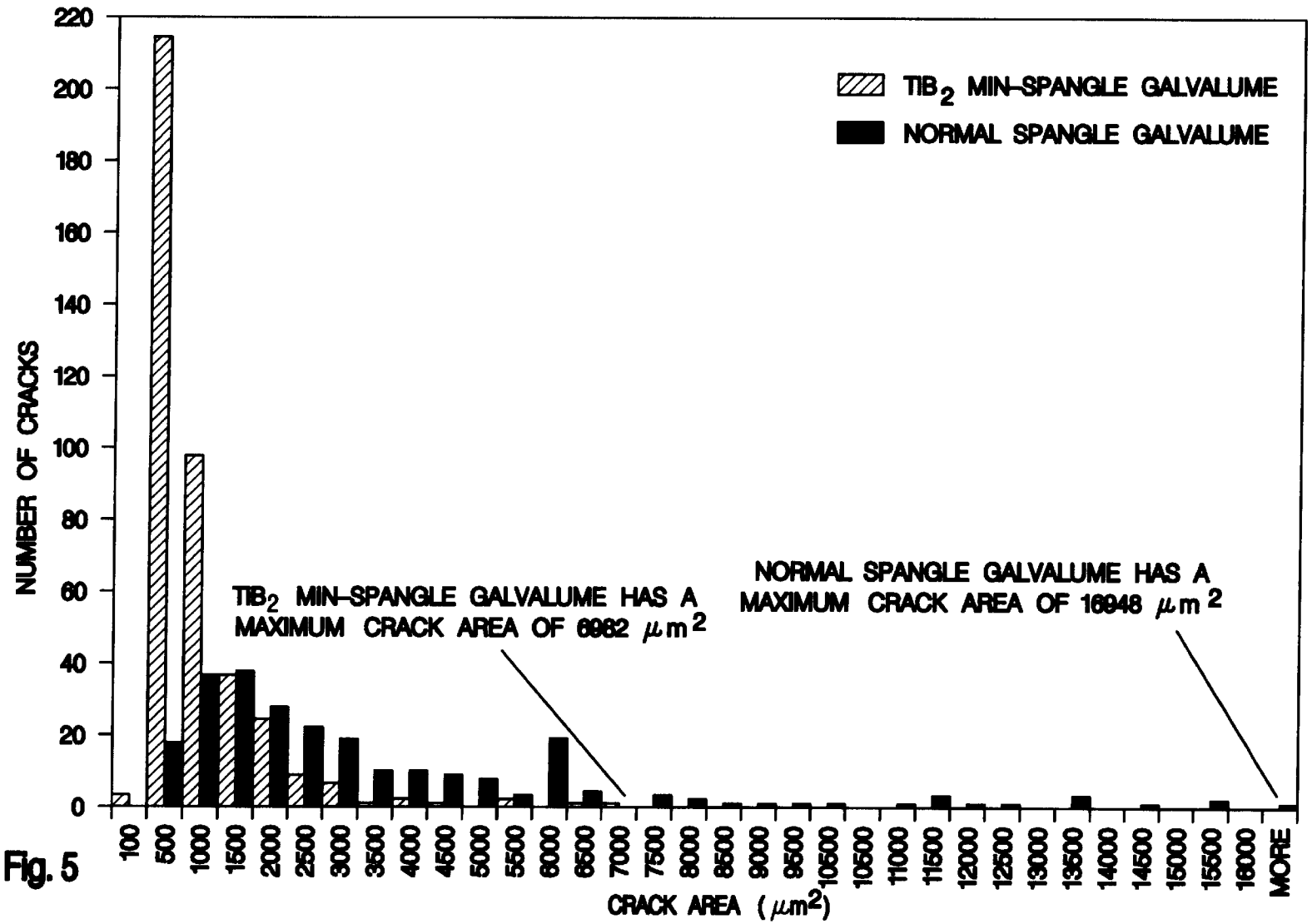
FIG. 5. is a graph comparing crack area and number of cracks for a coating composition containing titanium boride and a conventional coated steel product.

Another unexpected result associated with the invention is the formation of more numerous but small cracks during bending as compared to conventional aluminum-zinc alloy coatings of sheet product. Referring to FIG. 5, it can be seen that the titanium boride-modified aluminum zinc coated steel product has a significantly higher number of cracks than conventional aluminum zinc. However, the conventional product has a significantly increased crack area as compared to the titanium boride modified product. The smaller but more uniformly distributed cracks of the invention promote crack bridging by paint films. This bridging then facilitates choking off of corrosion products quicker than the larger cracks associated with conventional aluminum zinc coatings would. Thus, the titanium boride-coated product would exhibit improved corrosion resistance over prior art products.

The graph of FIG. 5 was based on bending a coated sample on a 1/16" cylindrical bend. The size of the cracks were measured after bending and a 19.71 square millimeter surface portion was examined for the number of cracks and their size. The maximum crack size in the inventive product is less than half (41%) of the size of the maximum crack size in the conventional product. This behavior is beneficial in preventing or reducing tension bend rust staining, where it is thought that the size of the worst cracks are what control the tension bend rust staining behavior of a coating.

Another equally important attribute of the invention is the surface quality of the inventive coated steel product and its improved suitability for painting. Table 3 shows profilometry results for a number of conventionally aluminum-zinc coated products and products coated with the titanium boride modified aluminum zinc alloy. The conventional product is noted as a Galvalume coating in Table 3. This table shows that the surface as-waviness ($W_{ca}$) of the coated product of the invention is substantially lower than the coated and temper rolled conventional Galvalume product. The average waviness of the as-coated and titanium boride-modified sheet is 67% better than the as-coated regular Galvalume product produced under identical conditions. The minimal spangle Galvalume waviness with the product of the invention is 50% better than the larger spangle mill produced temper rolled Galvalume. The titanium boride-modified minimum spangle Galvalume does not require temper rolling to reduce waviness, and is ideal for high speed coil coating applications. The appearance of the painted product is superior to large spangled as—coated and skin—passed Galvalume.

TABLE 3

Profilometry Results For A Number Of Conventional Galvalume Coatings And $TiB_2$, Modified Minimum Spangle Galvalume

| Coating Process/Line | Surface ID/ Condition | $R_a$($\mu$in) | $R_t$($\mu$in) | $W_{ca}$($\mu$in) | PC(ppi) |
|---|---|---|---|---|---|
| Galvalume w/$TiB_2$ Master Alloy | As-coated | 24.3 | 273.4 | 15.9 | 167 |
| Pilot Line Conventional Galvalume | As-coated | 16.7 | 196.1 | 48.4 | 58.0 |
| Average Mill Produced Galvalume | As-coated | 21.6 | 271.2 | 61.3 | 97.5 |
| | Temper Rolled | 47.3 | 354.9 | 39.6 | 153.5 |

Figure 6A:
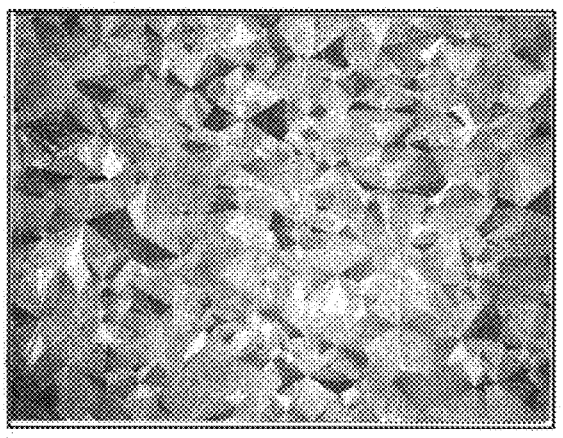
FIGS. 6*a*–6*c*. are photomicrographs showing spangle facet size for a conventionally coated product and a $TiB_2$-modified product.
Figure 6B:
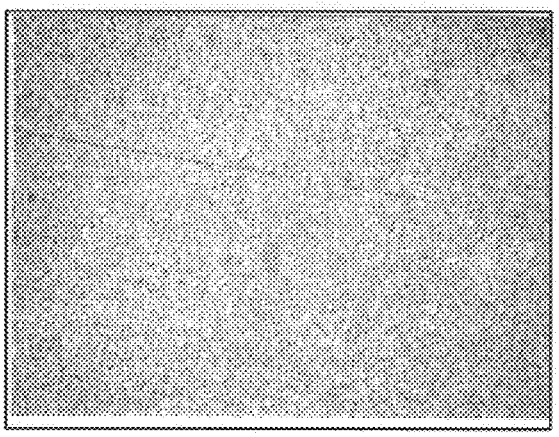
Figure 6C:
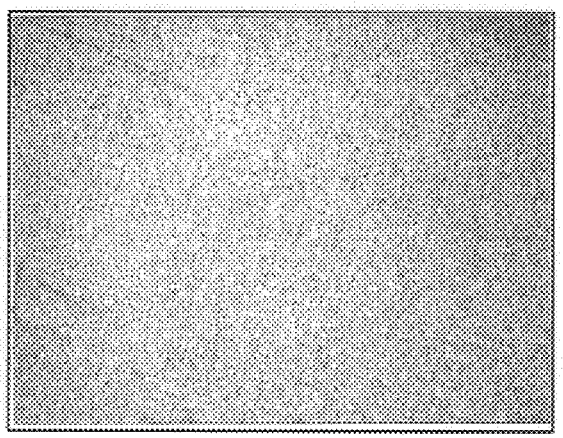
Figure 7A:
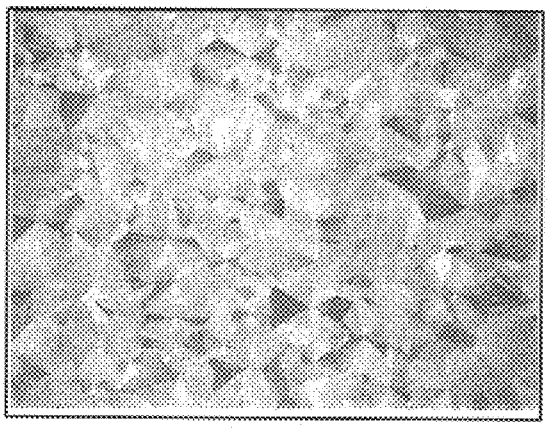
FIGS. 7*a*–7*c*. are photomicrographs showing spangle facet size for a conventionally coated product with and without titanium.
Figure 7B:
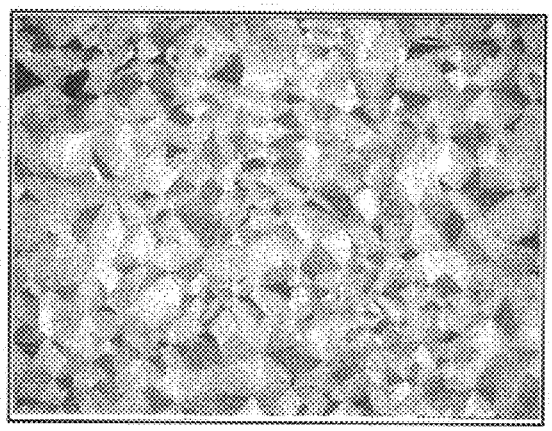
Figure 7C:
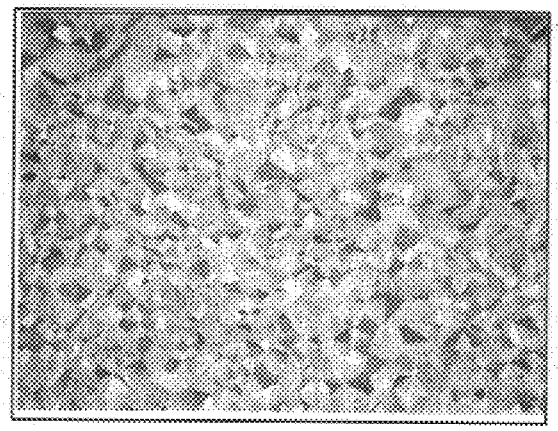
Figure 8A:
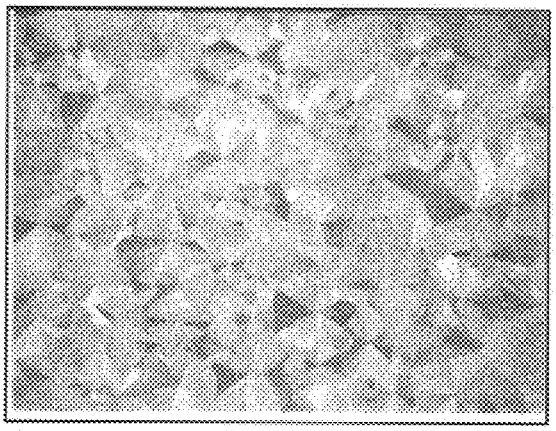
FIGS. 8*a*–8*c*. are photomicrographs showing spangle facet size for a conventionally coated product and a TiC-modified product.
Figure 8B:
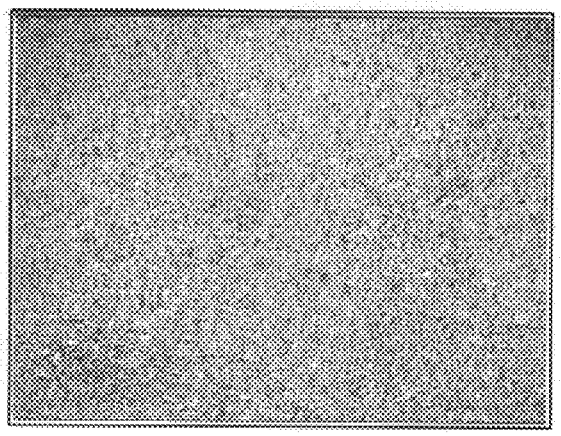
Figure 8C:
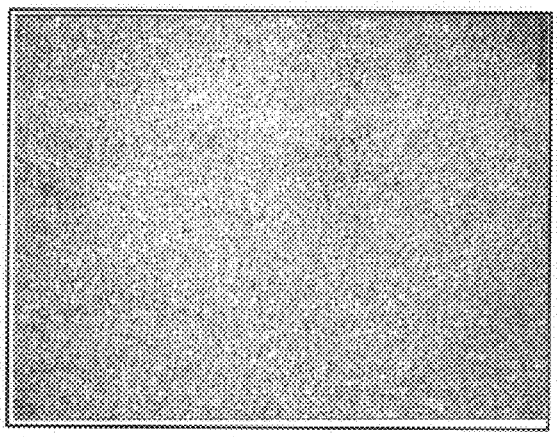
Figure 9A:
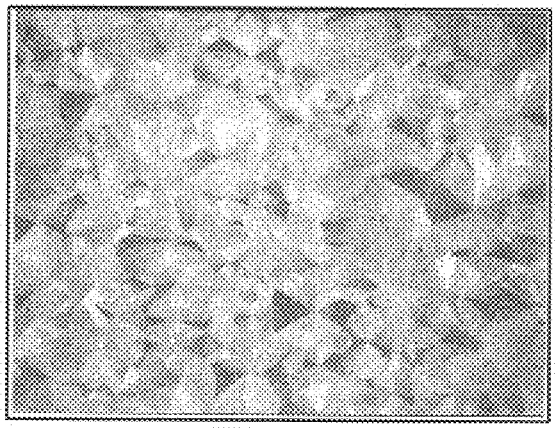
FIGS. 9*a*–9*c*. are photomicrographs showing spangle facet size for a conventionally coated product and an $AlB_2$–$AlB_{12}$ modified product.
Figure 9B:
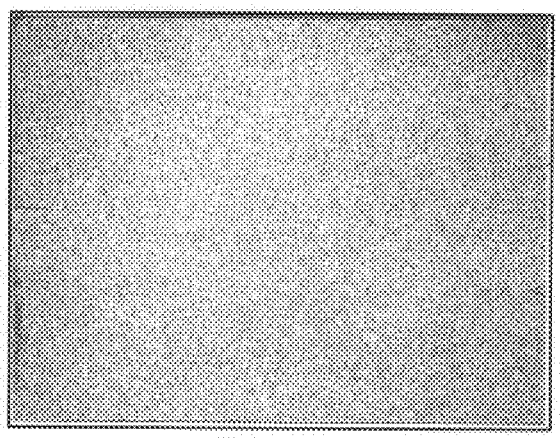
Figure 9C:
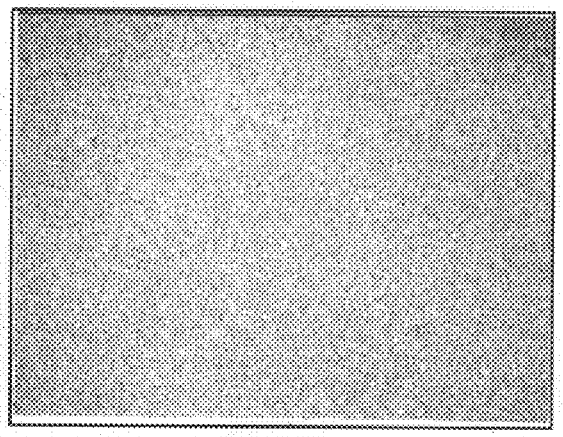

FIGS. 6A–9C compare the invention to the prior art and demonstrate the reduction in spangle facet size. FIGS. 6A–6C show the effect of $TiB_2$ added in the form of a Al-5% Ti-1% B master alloy, wherein a significant refinement of spangle facet size is achieved as compared to conventional Galvalume coatings. Similar reductions in spangle facet size are shown in FIGS. 8A–8C and 9A–9C when titanium carbide and aluminum borides are used as modifiers. Most importantly, when comparing FIGS. 6A–6C and FIGS. 7A–7C, particularly, FIGS. 6C and 7C, the addition of titanium alone does not produce the same spangle facet size reduction. In fact, the presence of titanium alone as compared to $TiB_2$ only marginally decreases spangle facet size.

Figure 10:
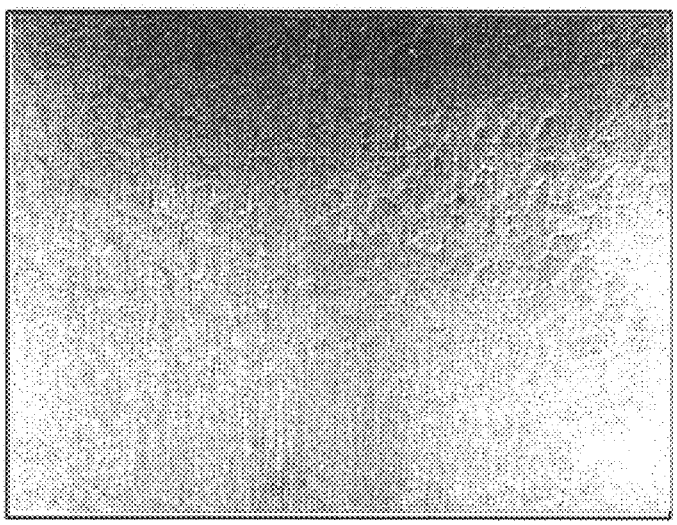
FIG. 10 is a photograph showing the surface appearance of a conventional 55% Al and Zn alloy coated product (Galvalume) without $TiB_2$ additions.

Referring to FIG. 10, it is well known in the art of hot-dip coating that brushing a conventional Galvalume coated product will produce a surface appearance that is very non-uniform and unappealing, the resulting brushed surface often being referred to as having an orange peel appearance associated with poor quality painted surfaces. Additionally, such brushed Galvalume coated products accentuate any surface irregularities that may be present in the hot-dip coated surface. Such accentuated irregularities diminish surface quality of the coated product.

Figure 11:
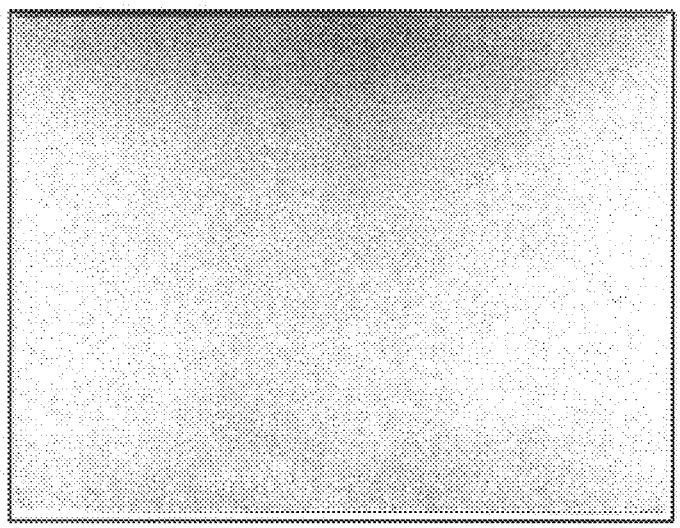
FIG. 11 is a photograph showing the surface appearance of a 55% Al and Zn alloy coated product (Galvalume) with $TiB_2$ additions.

Referring to FIG. 11, in contrast, when a minimized spangle hot-dip Al—Zn coated product made in accordance with the steps of the present invention is brushed, a more desirable finished surface simulating brushed stainless steel, brushed aluminum, or the like is produced. The resulting more desirable finished surface is absent any orange peel effect or accentuated surface irregularities that are present in brushed conventional Galvalume. Accordingly, in view of past teaching concerning the undesirable appearance of brushed Galvalume, our results are quite unexpected. Even more surprising is the unexpected discovery that by brushing the minimized spangle surface of the present invention we are able to produce a coated product that satisfies a long felt need for a low cost alternative to brushed stainless steel, or brushed aluminum, or other like brushed metal materials.

We have found that we are able to produce simulated brushed stainless steel or simulated brushed aluminum product by brushing the minimized spangle surface of the present invention with a non-woven, suspended abrasive brush, for example a 3M Scotch Brite® brush, or with a fiber brush such as a wire brush. The brushing process will impart a uniform, silvery metallic finish that simulates brushed stainless steel sheet or brushed aluminum sheet as shown in the photograph of FIG. 11. The minimized spangle coating comprising 55% Al, Zn, and the various above-disclosed compounds offers excellent long term corrosion resistance in combination with improved appearance that can not be duplicated by brushing a conventionally coated Galvalume product. As heretofore mentioned above, brushing a conventional Galvalume coated product produces orange peel and highlights any irregularities in the coated surface, making the coated surface aesthetically unappealing. On the other hand, the brushed surface of the present invention has a uniform appearance with only a brush scratch pattern being visible in the surface. A variety of selected brush scratch patterns may be created in the coated surface by using different brushing methods. The following examples illustrate two different methods for creating different brush scratch patterns in the minimized spangle coated minimized spangle Al—Zn alloy coated product made according to the steps of the present invention.

EXAMPLE 1

Sheet steel specimens were hot-dip coated to form the minimized spangled coating taught in the present invention. The hot-dip coated specimens were brushed in a three pass brushing process that produced a satin finish scratch pattern in the hot-dip coated surface. During brushing, the specimens were feed between 3M Scotch Brite 7S SFN Clean & Finish Flap brushes at a line speed of approximately 50 ft/min while a continuous water flow was applied to the brushed surfaces. The applied water flow provided a lubricant, a coolant, and a wash that removed brushing debris from the surfaces being brushed. The brushes were rotated at a speed of approximately 3600 surface ft/min. using a power supply of approximately 0.3 hp/in. of sample width.

EXAMPLE 2

Likewise, in example 2, sheet steel specimens were hot-dip coated to form the minimized spangled coating taught in the present invention. The hot-dip coated specimens were brushed in a three pass brushing process that produced a coarse finish scratch pattern in the hot-dip coated surface. During brushing, the specimens were fed between 3M Scotch Brite 7A Med Cut & Polish Flap brushes at a line speed of approximately 50 ft/min while a continuous water flow was applied to the brushed surfaces. The applied water flow provided a lubricant, a coolant, and a wash that removed brushing debris from the surfaces being brushed. The brushes were rotated at a speed of approximately 3600 surface ft/min. using a power supply of approximately 0.3 hp/in. of sample width.

After brushing, the surface characteristics were measured for the specimens in Example 1 and Example 2. It was discovered that, depending upon the particular specimen, and depending upon the roughness imparted to that sample by brushing, waviness ($W_{ca}$) along the brushed surface ranged from about 20–45 $\mu$in. It was also observed that roughness ($R_a$) along the brushed surfaces ranged between about 24.0–34.0 $\mu$in, and the peak count (PC) ranged between about 70–120 ppi. The brushing process used in Examples 1 and 2 did not remove more than about 5% of the 55% Al and Zn alloy coating mass per coated side. However, it should be understood that the amount of coating mass removed by brushing may be further minimized by optimizing the brushing parameters and that such changes in the brushing process fall within the scope of this invention. Considering such possible brushing modifications, the surface finish after brushing could have the following characteristics and still be considered acceptable from a visual appearance view point: $W_{ca}$=10.0–57.0 μin; $R_a$=20.0–50.0 μin; PC=45–200 ppi.

Figure 12:
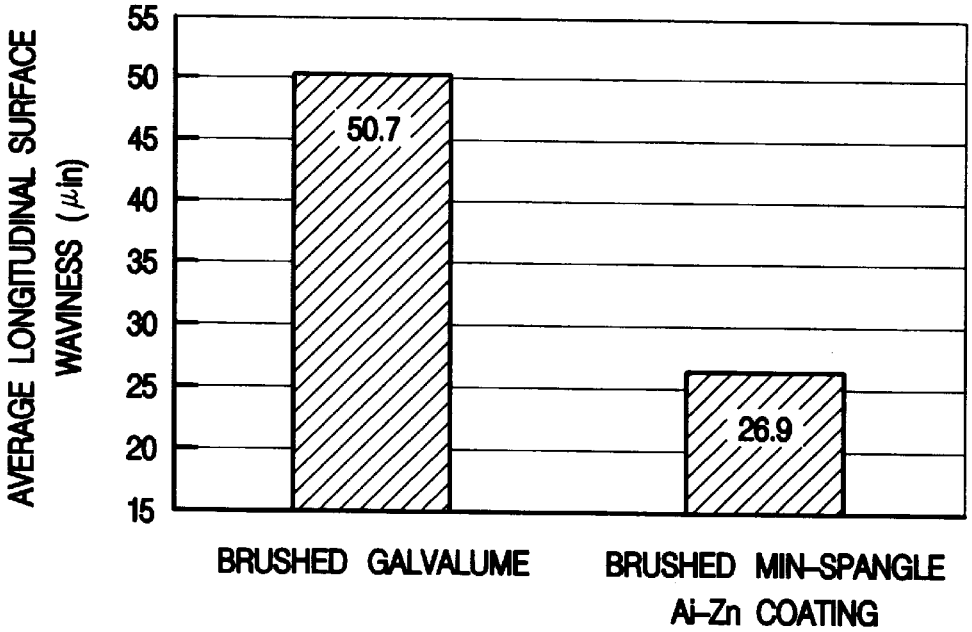
FIG. 12 is a bar graph comparing surface waviness between brushed minimized spangle Al—Zn coatings and brushed Galvalume coatings.

The brushed specimens of Examples 1 and 2 were compared with brushed conventional Galvalume coated specimens, and the waviness measurements for the two groups were averaged to provide the bar graph shown in FIG. 12. Surface waviness is one method used to quantify orange peel appearance. The Galvalume coated material was brushed using the same three pass brushing process described above. As clearly shown in FIG. 12, the brushed minimized spangle sheet of the present invention is about 26% less wavy along its brushed surface when compared to the brushed conventional Galvalume coated material.

Figure 13:
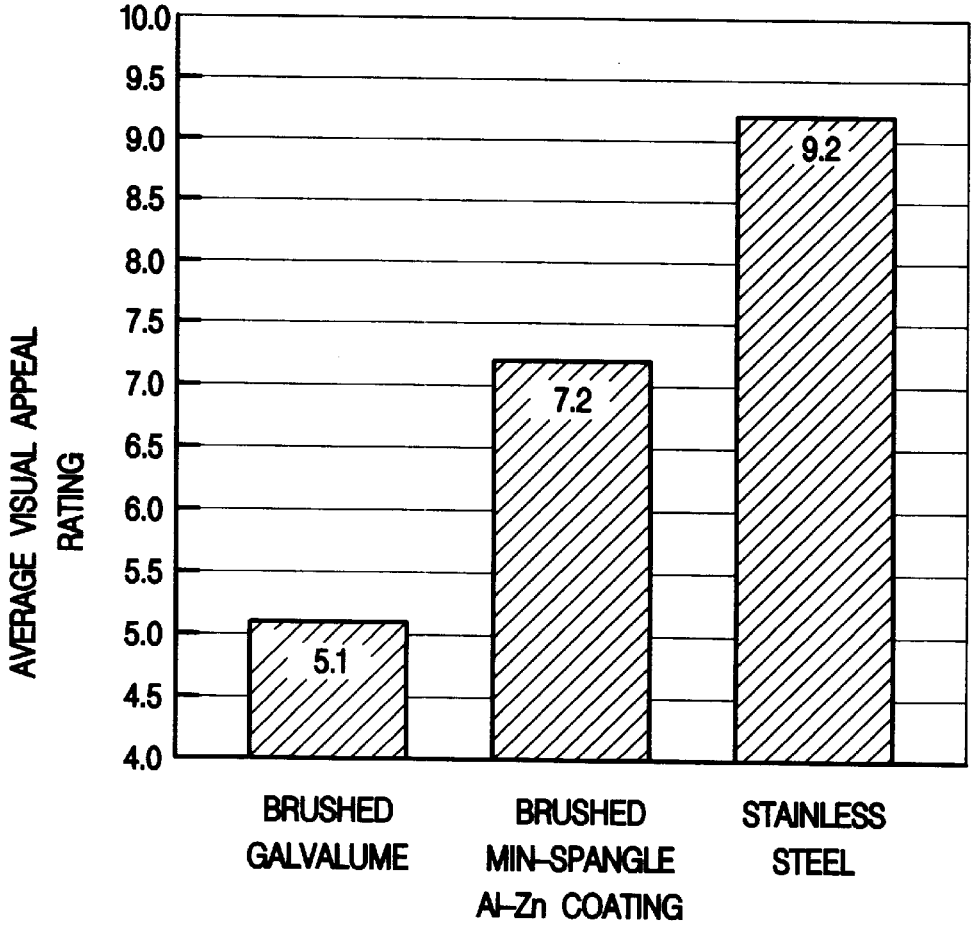
FIG. 13 is a bar graph comparing visual appearance between brushed minimized spangle Al—Zn coatings, brushed Galvalume coatings, and brushed stainless steel.

Additionally, because it is difficult to quantify appearance, a set of specimens was prepared, the set comprising brushed stainless steel specimens, brushed minimized spangle specimens, and brushed conventional Galvalume specimens. The prepared specimens were given to experts in the steel industry and experts in the field of hot-dip coating. We asked each expert to rank the specimens for visual appeal, and we asked them to base their ranking on which specimen visual appeal would be preferred in the manufacture of a household appliance, for example, a refrigerator. A ranking scale of 1–10 was used where (1) is visually poor and (10) is visually excellent. The expert rankings were averaged, and the results are shown in the FIG. 13 bar graph. The stainless steel specimens received the highest visual appeal ranking of 9.2 with the minimized spangle specimens receiving a 7.2. The conventional Galvalume specimens received the lowest ranking of 5.1. The results of the expert survey indicate that brushed minimized spangle Al—Zn alloy coated product of the present invention have an improved visual appearance when compared to the visual appearance in brushed conventional Galvalume coated products. Additionally, considering the above specimen ranking by experts, a brushed minimized spangle product of the present invention has a visual appearance that approaches the visual appearance of brushed stainless steel, and accordingly, such brushed minimized spangle product may be considered as a low cost alternative to the more expensive brushed stainless steel or brushed aluminum products in various material applications.

As such, an invention has been disclosed in terms of preferred embodiments thereof which fulfills each and every one of the objects of the present invention as set forth above and provides new and improved coated steel product, a method of making and a coating composition therefore.

Of course, various changes, modifications, and alterations from the teachings of the present invention may be contemplated by those skilled in the art without departing from the intended spirit and scope thereof. It is intended that the present invention only be limited by the terms of the appended claims.

We claim:

1. A coated steel article comprising a steel substrate having a brushed aluminum-zinc alloy coating thereon, said brushed aluminum-zinc alloy coating comprising: an effective amount of one or more of a particulate compound constituent selected from the group consisting of boride compounds having one of titanium and aluminum, aluminide compounds containing titanium and iron, and carbide compounds containing titanium, vanadium, iron, and tungsten so that said brushed aluminum-zinc alloy coating has a uniform appearance.

2. The article of claim 1, wherein said brushed aluminum-zinc alloy coating has a waviness of about $W_{ca}$=10 μin or higher.

3. The article of claim 1, wherein said brushed aluminum-zinc alloy coating has a waviness of between about Wca=19.0–57.0 μin.

4. The article of claim 1, wherein said brushed aluminum-zinc alloy coating has a waviness of between about Wca=20.0–45.0 μin.

5. The article of claim 1, wherein said brushed aluminum-zinc alloy coating has a roughness of less than about Ra=50 μin.

6. The article of claim 1, wherein said brushed aluminum-zinc alloy coating has a roughness of between about Ra=20.0–50.0 μin.

7. The article of claim 1, wherein said brushed aluminum-zinc alloy coating has a roughness of between about Ra=24.0–34.0 μin.

8. The article of claim 1, wherein said brushed aluminum-zinc alloy coating has a peak count of less than about PC=200 ppi.

9. The article of claim 1, wherein said brushed aluminum-zinc alloy coating has a peak count of between about PC=45–200 ppi.

10. The article of claim 1, wherein said brushed aluminum-zinc alloy coating has a peak count of between about PC=70–120 ppi.

11. The article of claim 1, wherein the particulate compound constituent is one of TiC, $TiB_2$, $AlB_2$, $AlB_{12}$, and $TiAl_3$.

12. The article of claim 1, wherein a particle size of the particulate compound constituent in the coating ranges between about 0.01 microns and about 25 microns.

13. The article of claim 1, wherein the particulate compound constituent is the carbide compound and the amount of the particulate compound constituent in the aluminum-zinc alloy ranges between about 0.0005 and about 0.01% by weight of carbon.

14. The article of claim 1, wherein the particulate compound constituent is the boride compound and the amount of the particulate compound constituent in the alloy bath ranges between about 0.001 and about 0.5% by weight of boron.

15. The article of claim 1, wherein the coating has a spangle facet size of between about 0.05 and 2.0 mm.

16. The article of claim 1, further comprising a painted surface on the brushed coated steel product.

* * * * *